US006892828B2

(12) United States Patent
Rives

(10) Patent No.: US 6,892,828 B2
(45) Date of Patent: May 17, 2005

(54) NUTATING SINGLE CONE DRILL BIT

(76) Inventor: Allen Kent Rives, 11831 Pebbleton, Houston, TX (US) 77007

( * ) Notice: Subject to any disclaimer, the term of this patent is extended or adjusted under 35 U.S.C. 154(b) by 0 days.

(21) Appl. No.: 10/709,097

(22) Filed: Apr. 13, 2004

(65) Prior Publication Data

US 2004/0200640 A1 Oct. 14, 2004

Related U.S. Application Data

(60) Provisional application No. 60/320,106, filed on Apr. 14, 2003.

(51) Int. Cl.[7] ..... E21B 10/08

(52) U.S. Cl. ..... 175/19; 175/343; 175/350

(58) Field of Search ..... 175/19, 57, 336, 175/339, 343, 350, 370, 378, 379

(56) References Cited

U.S. PATENT DOCUMENTS 4,096,917 A * 6/1978 Harris ..... 175/228
4,168,755 A * 9/1979 Willis ..... 175/343
4,372,403 A * 2/1983 Beeman ..... 175/343
4,886,130 A * 12/1989 Evans ..... 175/73

* cited by examiner

*Primary Examiner*—Zakiya Walker
(74) *Attorney, Agent, or Firm*—David B. Dickinson; Lundeen & Dickinson, LLP

(57) ABSTRACT

A nutating single cone drill bit includes a bit shank defining a bit axis, a journal defining a rotation axis skewed from the bit axis, and a cutter elements mounted upon a cutter body wherein the tip of each cutter elements is forward a plane defined normal to the cutter axis at an intersection of the cutter axis with the bit axis.

22 Claims, 6 Drawing Sheets

NUTATING SINGLE CONE DRILL BIT

CROSS REFERENCE TO RELATED APPLICATIONS

This application claims the benefit of U.S. Provisional Patent Application Ser. No. 60/320,106 filed on Apr. 14, 2003, by Allen Kent Rives, hereby incorporated herein by reference.

BACKGROUND OF INVENTION

The present invention generally relates to drill bits for boring subterranean and sub sea formations. More particularly, the present invention relates to a nutating single cone drill bit having a skewed axis of rotation to the central axis of the bit body in the borehole providing low torque and allowing high compressive loading on the bit assembly.

A number of single cone bits have been proposed through the years to drill bore holes for mining, oil and gas exploration, and utility construction. It has been previously recognized that a single cone bit would offer superior design characteristics, such as bearing size permitting greater longitudinal compressive loading on the drill bit. Previous, single cone drill bits however provided substantial scraping of the cutter elements causing abnormal wear and torque on the drill string assembly.

Each of the prior single cone drill bits were subject to excessive wearing of the cutting elements because at least during some portion of the rotation, the cutter elements were dragged by the circular motion of the bit on the journal across the formation face rather than moved in compressive engagement with the surface. These cutter elements are designed to have long use lives if used in compression, but having a tendency to break if subjected to side shear or scraping.

SUMMARY OF INVENTION

The present single cone drill bit provides a nutating single cone drill bit having a bit shank to connect to a drill string and providing an eccentric, skewed threaded bore; a threaded journal for engagement in the eccentric, skewed threaded bore of the bit shank; a cutter body rotatably carried on said journal; and a plurality of cutter elements affixed to an exterior peripheral side of said cutter body so that a tip of each cutter element is forward an intersection of a central axis of the drill bit body and an axis of rotation of the cutter body and a first chordal distance to the tip of each cutter element from an axis of cutter rotation is longer than a second chordal distance to said tip of each cutter element from an axis of the bit body rotation. The rolling nutating action of the present bit lifts the opposing cutter buttons off the face of the borehole while the cutters directly at the borehole face engage the rock to be crushed or cut. The skewed angle of the cutter body as it rotates prevents the non-cutting elements from dragging across the opposing face and thereby reduces the wear experienced by the bit overall.

Since the present invention offers low resistance to the rotational movement of the drill string, it provides a much lower operating torque and may be used with much smaller drilling rigs such as those used by utility contractors for drilling purposes. The low torque of this drill bit also lowers the cost of power used for a normal drilling program.

The present invention can be threaded on a drill string, a drilling motor, a drill pipe stabilizer or other types of bottom hole assemblies, all in the manner well known in the drilling industry. The drill bit shank is eccentrically tapped to provide a threaded bore into which is threaded a journal which forms a skewed angle to the longitudinal axis of the drill bit shank. The drill bit shank also provides a breaker slot to permit a standard bit breaker to be used to connect and disconnect this drill bit to the drill string. The journal supports a cutter body having a number of cutter elements disposed on its peripheral face. The cutter body is supported on large roller bearings which provide rolling engagement. Since the journal is set in the drill bit shank at the acute skewed angle, and the tip of each cutter element is farther from the axis of rotation of the cutter body than from the axis of rotation of the drill bit shank and since each tip extends forward a perpendicular plane formed at the intersection of the longitudinal axis of the bit shank and the rotational axis of the cutter body, the cutters engage the surface in a rolling and crushing movement and then are lifted off the face of the borehole thereby preventing them from being dragged.

DETAILED DESCRIPTION

The present invention includes a single cone bit having an axis of rotation skewed from the longitudinal axis of the drill string to which it can be attached providing substantial main thrust bearings and providing a cutter shell and cutter elements disposed so that each cutter element tip lies forward intersection of the central axis of the drill bit body and the axis of rotation of the cutter shell so that the chordal distance to the tip of each cutter element from the axis of cutter rotation is always longer than the chordal distance to the tip of each element from the axis of the bit body rotation.

Figure 1:
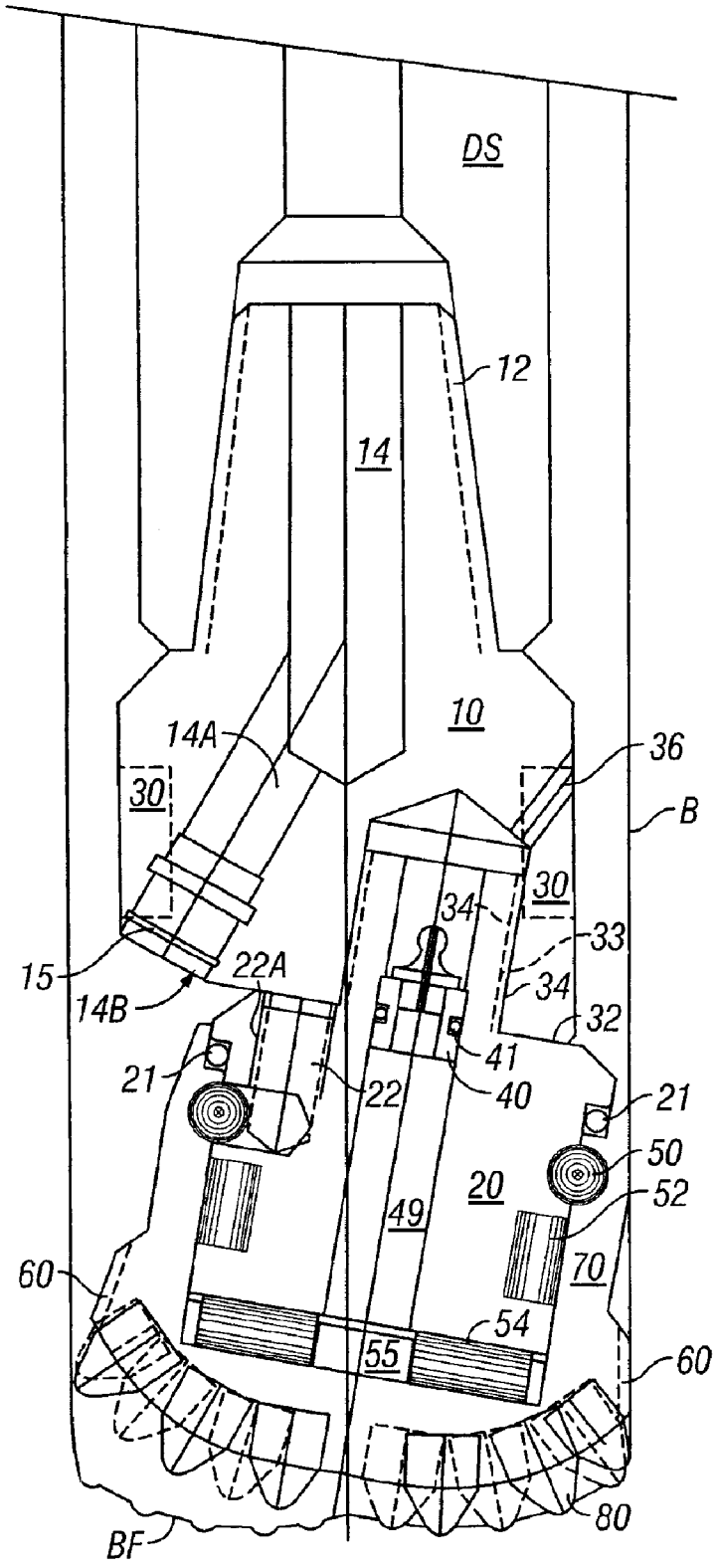
FIG. 1 is a cross sectional view of the bit of the present invention.

As shown in FIG. 1, the drill bit is mounted on a drill bit shank 10 which provides threaded connections 12 for connection to a drill string, drill motor or other bottom hole assembly (shown schematically as DS) in a manner well known to those in the drilling industry. The drill bit shank 10 also provides a longitudinal passage 14 to allow fluid communication of drilling fluid through the jetting passage 14*a* and through standard jetting nozzle 15 to be jetted against the bore B and bore face BF through opening 14*b* adjacent the drill bit cutter body 70.

The drill bit shank 10 provides a bit breaker slot 30, a groove formed on opposing lateral sides of the bit shank 10 to provide cooperating surfaces for a bit breaker slot in a manner well known in the industry to permit engagement and disengagement of the drill bit with the drill string assembly DS.

Journal 20 is provided with screw threads 22 and is threaded into the bit shank 10, tapped eccentrically off the central longitudinal axis of the bit shank which provides a flattened end 32 at a skewed acute angle from the longitudinal axis of the bit shank 10. In the present disclosed drawing this skewed angle is about ten degrees (10°) from the longitudinal axis, although other angles may be chosen, preferably in the range of 7° to 13°, depending on the geometry and size of the cutter body and the cutter elements used. The hole tapped into the body of the bit shank 10 at the acute angle also provides a port 36 to the lateral exterior of the bit shank to permit hydraulic communication into the tapped hole to pressure balance a floating grease seal nipple 40 which provides O-ring seals 41 to seal the nipple 40 in a central passage 49 of the journal body 20. The central passage 49 of the journal also acts as a grease reservoir to continuously provide lubrication to the bearings retained between the journal and the cutter body. Since the journal 20 is also sealed with larger O-ring 21 to prevent ingress of drilling fluid into the bearing surfaces formed between the external surface of the journal 20 and the interior surface of the cutter body 70, the external pressure found in the bore is balanced on both sides of the grease seal, all in a manner well known in this industry.

Journal 20 supports a thrust roller bearing cage 55, providing a plurality of roller bearings 54 allowing substantial compressive longitudinal force to be exerted against the drill bit without impeding its free rotational movement about the journal axis of rotation. The axis of rotation of the journal 20 is skewed from the normal longitudinal axis of the drill bit shank by about 10°.

The cutter body 70 is carried on the journal 20 and provides a plurality of hardened cutter elements 80, which are inserted on its exterior peripheral surface to engage the bore face BF. The skew angle of the cutter body 70 and the curvature of the peripheral face of the cutter body 70 is such that a portion of cutter elements 80 engage the surface while opposing cutter elements are held off the bore face BF. The cutter body also provides a plurality of junk slots 60 which permit the cuttings to flow past the drill bit in the bore B.

The cutter body 70 is retained on the journal 20 by retainer bearings 50 which are inserted into a bearing raceway formed between the inner surface of the cutter body 70 and the outer surface of the journal 20. The plurality of retainer bearings 50 are retained in the raceway by retainer plug 22, which may be a cap head screw or a snap-ring-retained pin by way of example only, all in a manner well known to those in this industry. A plurality of roller bearings 52 are also provided to support the cutter body 70 in a groove formed in the lateral sides of the journal body 20 to provide relief from shear stress on the cutter body 70. Other types of bearings, such as ball or friction bearings, may be substituted for the bearings described herein without departing from the spirit or intent of the disclosure contained herein. The journal 20 and cutter body 70 are assembled by packing the roller bearing cage 55 and roller bearings 52 with grease in the cutter body 70 and journal 20. Then ball bearings 50 are inserted through the retainer plug port 22*a* and moved around the race to hold the cutter body 70 on the journal 20. Retainer plug 22 is then inserted in the port 22*a* to hold the assembled cutter body 70 and journal together, and additional grease is injected into the grease reservoir to fill the reservoir 49 completely.

The drill bit shank 10 is assembled by connecting the assembled cutter body 70 and journal 20 is screwed into the drill bit shank 10. Flats milled into the exterior body of the journal 20 allow a wrench to be used to tighten the journal threads 33 in the drill bit shank tapped hole 34 and the drill bit is thereafter ready for connection by threads 12 to a drill string, drilling motor or centralizer assembly with drill collars (collectively referred to herein as DS) in a manner well known in the drilling industry.

In operation, the drill bit performs in the same manner as any other drill bit, but since it offers low torque may be operated at higher speeds without adverse effects. Fluid is pumped through the interior of the drill string through the shank 10, into passages 14 and 14*a*, and out the jetting nozzle 15 through opening 14*b* in a manner well known to the drilling industry to carry cuttings away from the borehole face and to cool the drill bit in operation.

Figure 2:
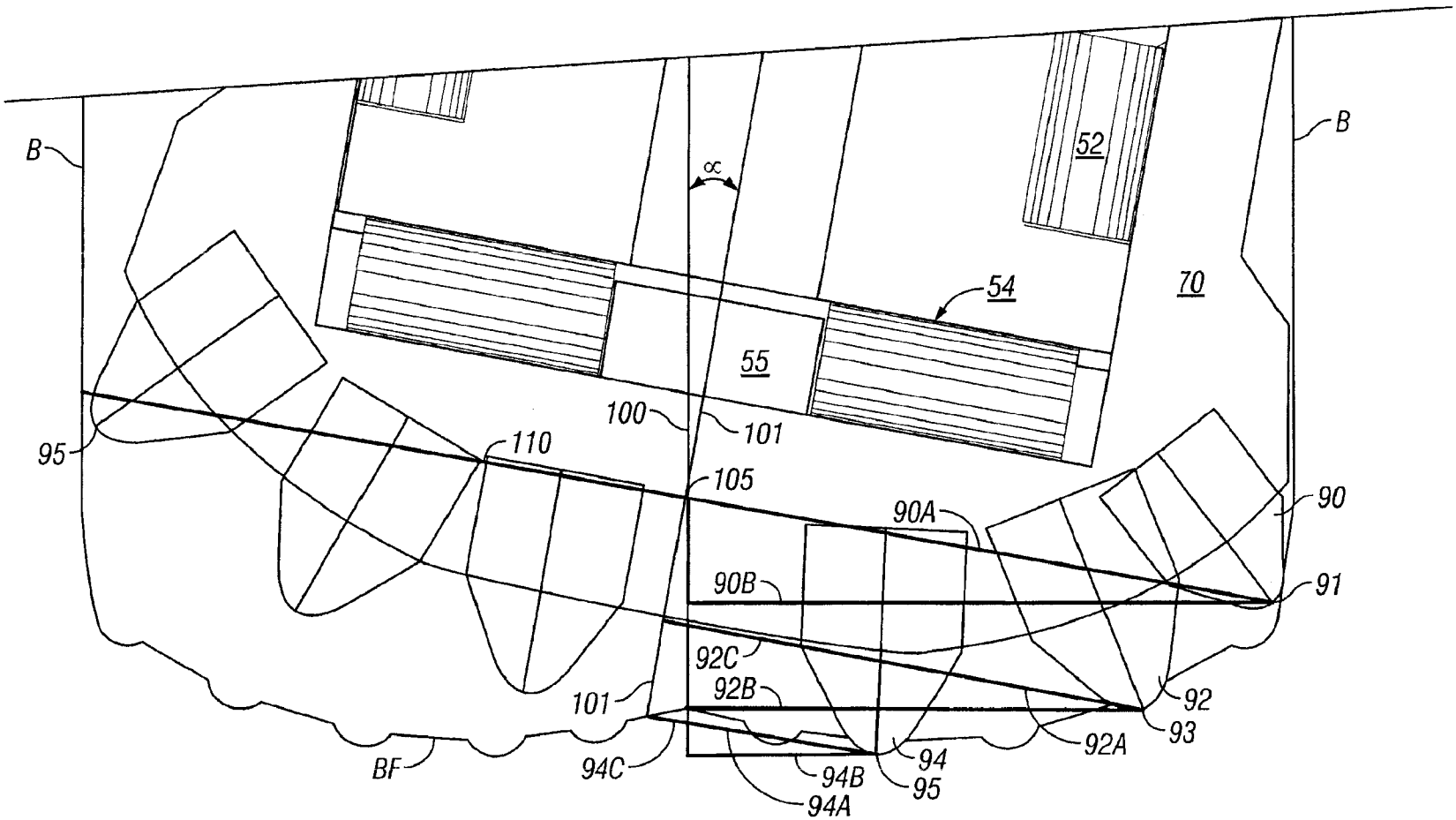
FIG. 2 is a partial cross-sectional view of the cone face showing the relative disposition of the cutter elements on the cutter body.

FIG. 2 is an enlarged drawing of FIG. 1 cutter body 70 more clearly showing the geometric relationship of the cutter body 70, representative plural cutter elements (90, 92, 94), and the skew acute angle □ about the axis of rotation of the drill bit 100 of the axis of rotation of the cutter body 101. As previously noted, each tip of each cutter element on the cutter body 70 is forward of the plane of intersection 110 about the point 105, wherein point 105 is the intersection of bit axis 100 and cutter body rotational axis 101. Further, the chordal distance 90*a* to the tip 91 of cutter element 90 to the center of the axis of rotation 101 about the point 105 is greater than the chordal distance 90*b* from the center line 100 of the drill bit of the present invention. Tip 95 is likewise always forward of the plane 110 about the point 105. Similarly, each cutter element populating the surface of the cutter body 70 is arranged so that the same spatial relationship is satisfied. Cutter element 92 provides a tip 93 which has a chordal distance 92*a* to the axis of rotation 101 of the cutter body 70 greater than the chordal distance 92*b* of the tip 93 to axis of rotation 100 of the drill bit.

Likewise, cutter element 94 provides a tip 95 which has a chordal distance 94*a* to the axis of rotation 101 of the cutter body 70 greater than the chordal distance 94*b* of the tip 95 to axis of rotation 100 of the drill bit. This creates a continuous forward motion of the cutter body relative to the bore face BF although slower than the rotation of the axis of the drill string DS. The additional distance 92*c* and 94*c* between the axis of rotation of the bit and the axis of rotation of the cutter body for each respective cutter element tip causes each more interior tip to move faster relative to the movement of the drill string on the bore face BF, although the cutter shell rotates relatively slower than the drill bit shank.

Figure 3:
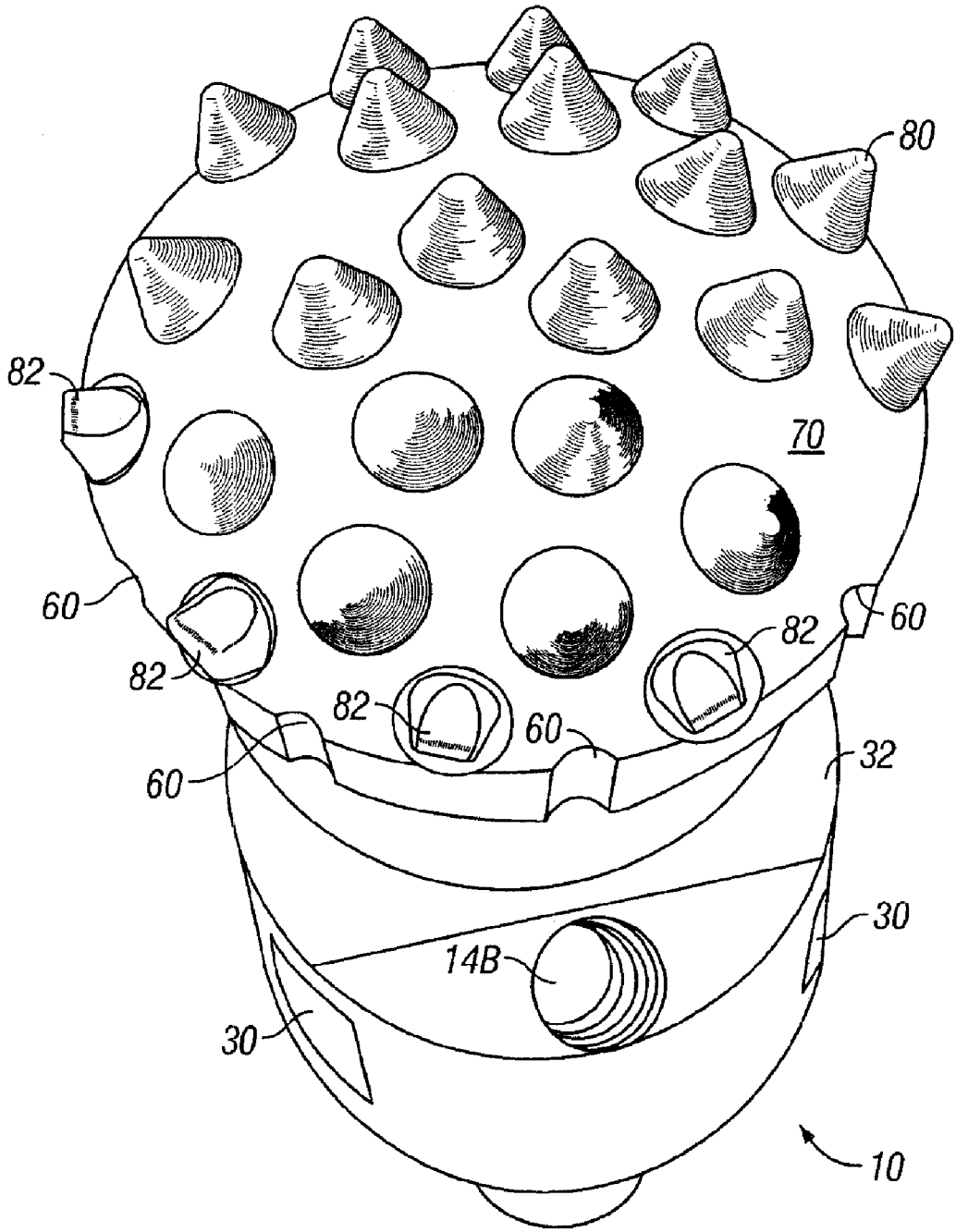
FIG. 3 is a perspective view of one embodiment of the drill bit from the cutter body side of the bit providing an outer peripheral row of chisel point cutter elements combined with conical shaped cutter elements.

FIG. 3 is a perspective view of the cutter body 70 mounted on the drill bit shank 10 on a skewed surface 32. The breaker slots 30 on opposing lateral sides of the bit shank 10 allow the drill bit, after assembly, to be connected to a drill string assembly (not shown in this view). The jetting port 14*b* is shown without the jetting nozzle in this view, but such nozzles and the technique of design and manufacture of such assemblies is well known in this industry. Junk slots 60 are formed in the lateral surfaces of the cutter body 70 to allow the cuttings from the bore face BF to flow past the drill bit and up the bore B with the hydraulic drilling fluid.

As can be more fully appreciated from the perspective view of FIG. 3, the plurality of cutter elements can be asymmetrically disposed on the cutter body 70. Further, chisel point cutter elements 82 can be disposed around a lateral edge of the cutter body 70. Other combinations of cutter elements, such ogive, domed, kerf, or types of cutter elements with polycrystalline diamond coatings or mill tooth surface treatments can be used in the present invention as long as they satisfy the criteria that all tips or the leading edge of the cutter face lay forward of the plane formed by the axis of rotation of the cutter body at the point where it intersects the axis of rotation of the drill bit and that the chordal distance to each tip or face element from the axis of rotation of the cutter body is greater than the chordal distance of the tip or face element to the central axis of rotation of the drill bit, all as more fully described herein previously.

Figure 4:
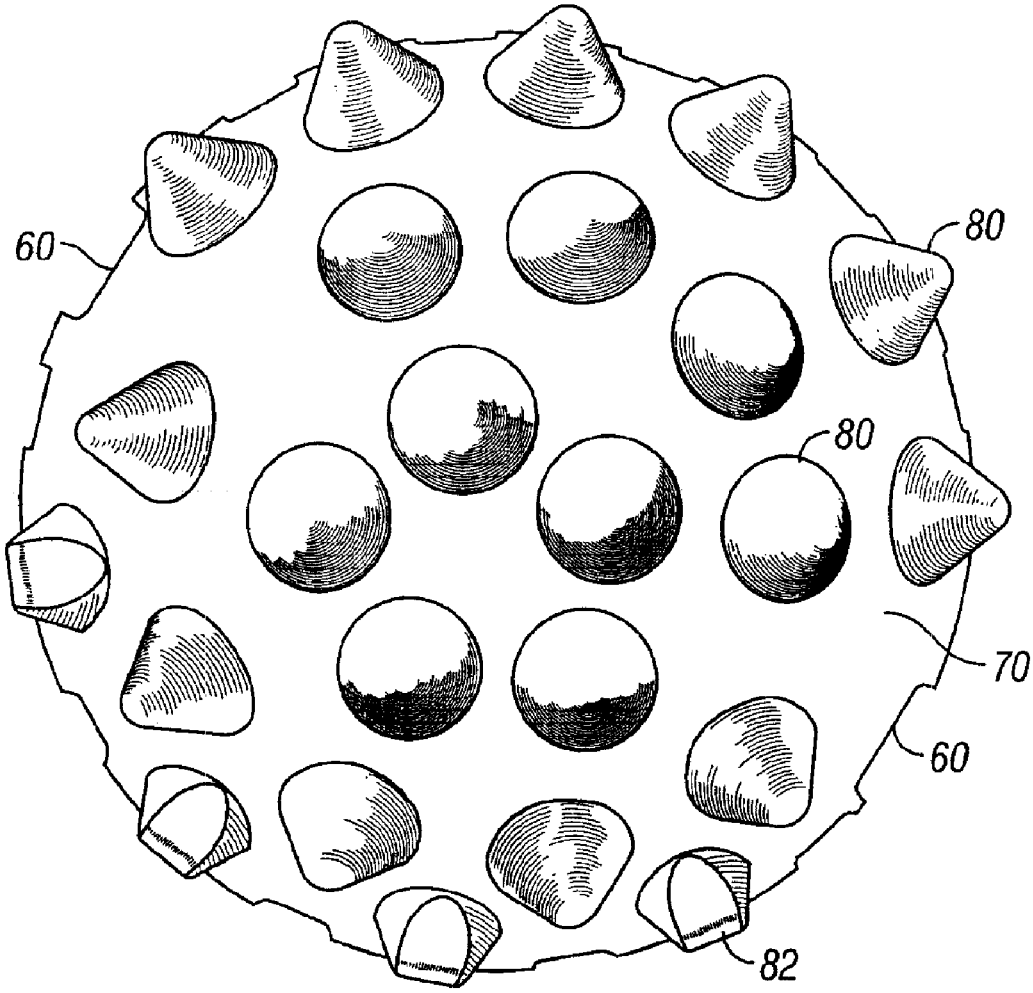
FIG. 4 is an end perspective view of the embodiment of the drill bit shown in FIG. 3.

FIG. 4 is an end view of the drill bit shown in FIG. 3 above. Cutter body 70 provides a plurality of chisel point cutter elements 82 on a portion of the outer peripheral lateral edge of the cutter body with the remaining conical cutter elements 80 populating the remainder of the cutter body 70.

Figure 5:
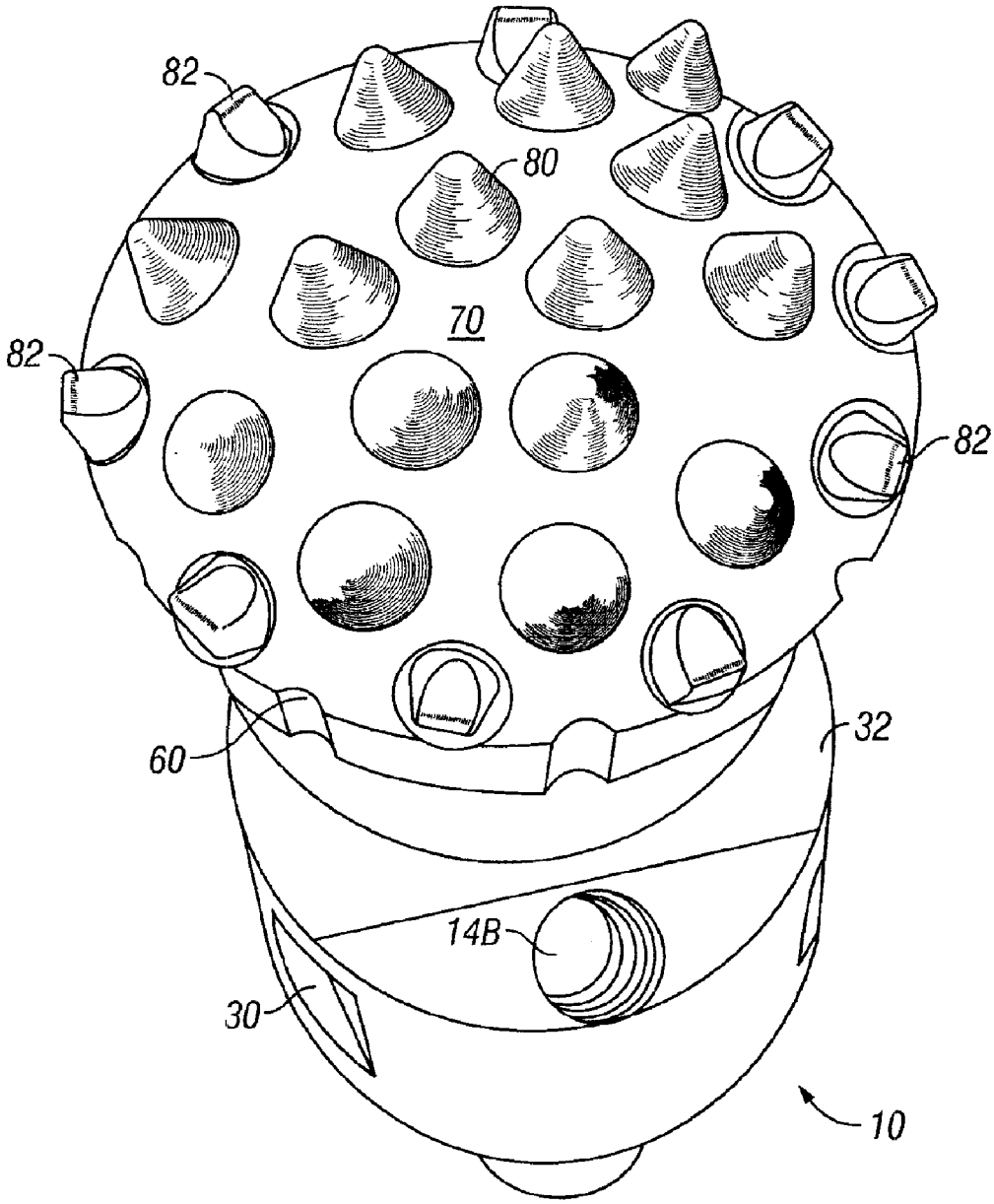
FIG. 5 is a perspective view of another embodiment of the drill bit from the cutter body side of the bit providing an outer peripheral row of chisel point cutter elements around the circumference of the bit surface.

Similarly, FIG. 5 is a perspective view of another embodiment of the drill bit of the present invention providing a bit shank 10 having a jetting passage 14*b* into which is inserted a jetting nozzle well known to those in this industry. The bit shank 10 further provides a skewed flattened end 32 and breaker slots 30, into which is screwed the journal (not shown in this view) carrying cutter body 70, having junk slots 60, populated with chisel point cutter elements 82 around its entire outer peripheral lateral edge and conical cutter elements 80 on the interior portion of the outer surface of the cutter body 70.

Figure 6:
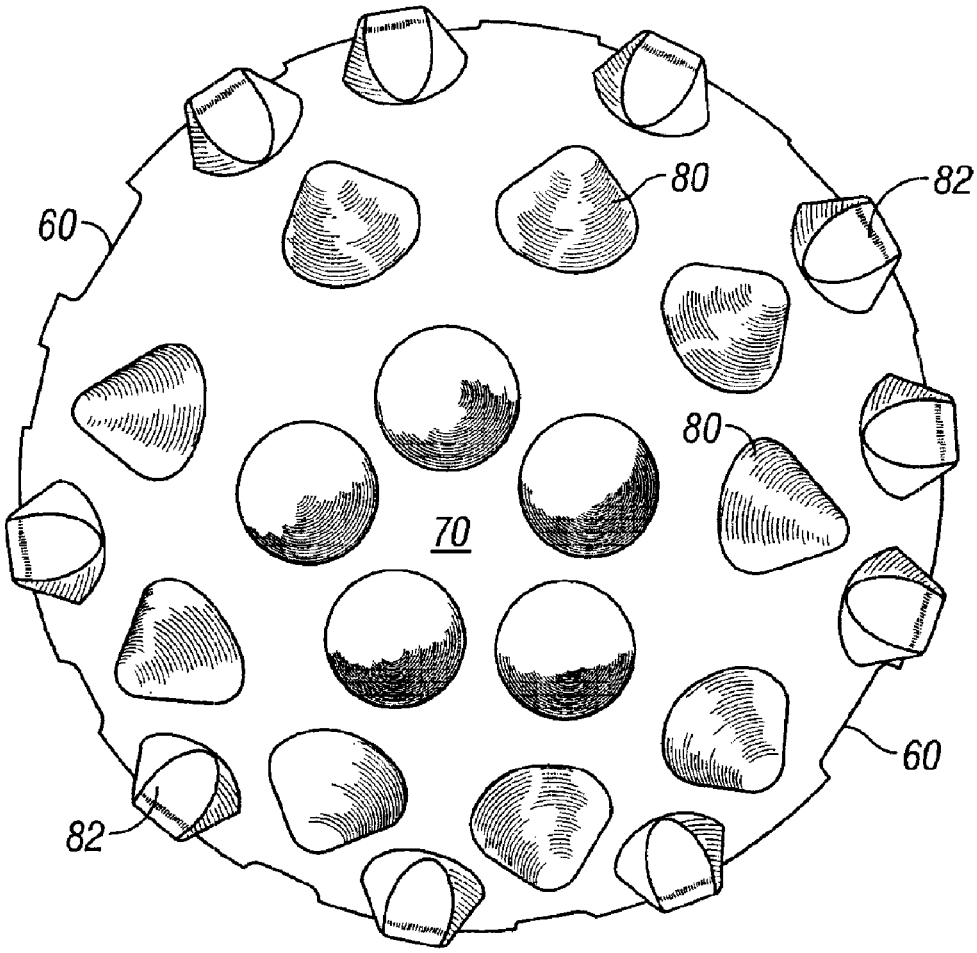
FIG. 6 is an end perspective view of the embodiment of the drill bit shown in FIG. 5.

FIG. 6 is a end perspective view of the drill bit of FIG. 5 more clearly showing the junk slots 60 and the plurality of the chisel point cutter elements 82 on the outer peripheral lateral edge of the cutter body 70 and the plurality of conical cutter elements 80 on the interior portion of the cutter body 70.

This new and improved single cone eccentric bit combines low torque, and high penetration rates with long service life. Although the preceding description and specification contains specific detail concerning the construction and operation of the preferred embodiment, it should not be construed as limiting the scope of the invention, but as merely providing illustrations of the presently preferred embodiments of this invention. The claims attached hereto and their reasonable equivalents more fully detail the scope of the invention described herein.

What is claimed is:

1. A nutating single cone drill bit comprising:

a bit shank to connect to a drill, string and providing an eccentric, skewed threaded bore;

a threaded journal for engagement in the eccentric, skewed threaded bore of the bit shank;

a cutter body rotatably carried on said journal;

a plurality of cutter elements affixed to an exterior peripheral side of said cutter body so that a tip of each cutter element is forward an intersection of a central axis of the drill bit body and an axis of rotation of the cutter body and a first chordal distance to the tip of each cutter element from an axis of cutter rotation is longer than a second chordal distance to said tip of each cutter element from an axis of the bit body rotation.

2. The nutating single cone drill bit of claim 1 further comprising a jetting passage from an interior passage of said drill bit to an exterior of said bit adjacent the cutter body to permit hydraulic communication from the interior to the exterior of the drill bit to carry cuttings from a bore.

3. The nutating single cone drill bit of claim 1 further comprising pressure-compensated lubrication fitting in said journal body.

4. The nutating single conc drill bit of claim 1 further comprising a thrust bearing between a exterior surface of the journal and an interior surface of the cutter body.

5. The nutating single cone drill bit of claim 1 further comprising a plurality of bearings in a bearing race formed in a groove on the exterior lateral surface of the journal, retained therein by an interior lateral surface of the cutter body.

6. The nutating single cone drill bit of claim 1 further comprising a plurality of bearings retained in a bearing race formed on an exterior lateral surface of the journal and an interior lateral interior surface of the cutter body.

7. The nutating single cone drill bit of claim 1 further comprising a breaker slot on an exterior surface of the bit shank.

8. The nutating single cone drill bit of claim 1 wherein the skew angle of the journal is about 10° from the longitudinal axis of drill bit shank.

9. The nutating single cone drill bit of claim 1 wherein the exterior lateral surface of the cutter body provides a plurality of junk slots to permit cuttings to move past the cutter body in a bore.

10. A single-cone cutter shell comprising:

a hemispheric body having a interior surface to support a plurality of bearings on a journal having a rotational axis skewed to a central axis of a drill string; and, a plurality of cutter elements disposed on an outer surface of said hemispheric body arranged so that a tip of each said cutter element lies forward a plane perpendicular to a rotational axis of the hemispheric body and said plane passing through an intersection between the rotational axis and the central axis; and each said tip is farther from the rotational axis of the hemispheric body than from the central axis of the drill string.

11. The single-cone cutter shell of claim 10 wherein each such cutter element is conical.

12. The single-cone cutter shell of claim 10 wherein each such cutter element is chisel pointed.

13. The single-cone cutter shell of claim 10 wherein the cutter elements are conical and chisel pointed, with said chisel pointed cutter elements positioned on at least a portion of said outer peripheral edge of said cutter shell.

14. A single cone rotary drill bit comprising:

a bit shank configured to connect to a drill string, said bit shank defining a bit axis and including a receptacle bore;

a journal to be engaged within said receptacle bore, said journal configured to retain a cutter body thereupon, said cutter body defining a rotation axis;

said rotation axis skewed from said bit axis by a skew angle; and a plurality of cutter elements mounted upon said cutter body, said cutter elements configured so that a tip of each cutter element is forward a plane defined normal to said cutter axis at an intersection of said cutter axis and said bit axis.

15. The single cone rotary drill bit of claim 14 wherein:

said tips of said cutter elements each include a first chordal distance from said rotation axis and a second chordal distance from said bit axis; and said first chordal distance is longer than said second chordal distance for each cutter element.

16. The single cone rotary drill bit of claim 14 further comprising a thrust bearing positioned between said cutter body and said journal.

17. The single cone rotary drill bit of claim 14 further comprising a rotational bearing between said cutter body and said journal.

18. The single cone rotary drill bit of claim 14 wherein said skew angle is 10 degrees.

19. A drill bit comprising:

a connection to a drillstring said drillstring defining a drillstring axis;

a cutter body, said cutter body defining a rotational axis wherein said rotational axis is skewed from said drillstring axis by a skew angle; and a plurality of cutter elements dispersed about said cutter body, each cutter element having a tip, wherein each tip is forward a plane defined normal to said rotational axis at the intersection of said rotational axis and said drillstring axis.

20. The drill bit of claim 19 further wherein said tips of said cutter elements each have a first chordal distance from said rotational axis and a second chordal distance from said drillstring axis, wherein said first chordal distance is longer than said second chordal distance.

21. A method to drill a formation, the method comprising:

attaching a single cone drill bit to a drillstring, the single cone drill bit configured such that a cutter body of the single cone drill bit includes a plurality of cutter elements, each cutter element having a tip forward a plane defined by about an axis of rotation of the cutter body at an intersection of the axis of rotation with an axis of rotation of the drillstring;

engaging the drillstring with attached single cone drill bit into a bore; and rotating the drillstring to drill the formation with the single cone drill bit, wherein the cutter body rotates slower than the rotation of the drillstring and the cutter elements crush the formation coming into contact therewith.

22. The method of claim 19 wherein the tips of the cutter elements each include a first chordal distance from the cutter axis and a second chordal axis from the drillstring axis, wherein the first chordal distance is longer than the second chordal distance for each cutter element.

* * * * *

UNITED STATES PATENT AND TRADEMARK OFFICE

CERTIFICATE OF CORRECTION

PATENT NO. : 6,892,828 B2
DATED : May 17, 2005
INVENTOR(S) : Rives, Allen Kent

It is certified that error appears in the above-identified patent and that said Letters Patent is hereby corrected as shown below:

Column 5,
Line 43, should read -- drill string --.

Signed and Sealed this

Thirtieth Day of May, 2006

JON W. DUDAS
*Director of the United States Patent and Trademark Office*